US011559130B2

(12) United States Patent
Hu

(10) Patent No.: US 11,559,130 B2
(45) Date of Patent: Jan. 24, 2023

(54) FIXING DEVICE AND STRAP ASSEMBLY

(71) Applicant: Tienchi Hu, Taipei (TW)

(72) Inventor: Tienchi Hu, Taipei (TW)

( * ) Notice: Subject to any disclaimer, the term of this patent is extended or adjusted under 35 U.S.C. 154(b) by 10 days.

(21) Appl. No.: 17/355,398

(22) Filed: Jun. 23, 2021

(65) Prior Publication Data

US 2022/0408906 A1 Dec. 29, 2022

(51) Int. Cl.
*G03B 17/56* (2021.01)
*A45F 5/00* (2006.01)

(52) U.S. Cl.
CPC ..... *A45F 5/00* (2013.01); *A45F 2005/006* (2013.01); *A45F 2200/0533* (2013.01)

(58) Field of Classification Search
CPC ..... A45F 2200/0533; A45F 2005/006; Y10S 224/908; A45C 11/38; G03B 17/561; G03B 17/563
USPC ..... 224/578, 908
See application file for complete search history.

(56) References Cited

U.S. PATENT DOCUMENTS 3,152,738 A * 10/1964 Worsfold, Jr. ..... A45F 5/00 224/259
3,305,148 A * 2/1967 Zimmerman ..... A45F 5/00 224/908
3,559,853 A * 2/1971 Strassman ..... A45F 5/00 294/149
4,446,997 A * 5/1984 Himberg ..... A45F 5/00 224/908
6,955,484 B2 * 10/2005 Woodman ..... F16M 13/00 224/267
8,678,679 B2 * 3/2014 Xu ..... G03B 17/563 396/423
10,165,837 B2 * 1/2019 Busam ..... A45C 13/30
2012/0048901 A1 * 3/2012 Wong ..... A45F 5/00 224/257
2022/0187689 A1 * 6/2022 Cursley ..... H04N 5/2252

* cited by examiner

*Primary Examiner* — Adam J Waggenspack

(74) *Attorney, Agent, or Firm* — Locke Lord LLP; Tim Tingkang Xia, Esq.

(57) ABSTRACT

A fixing device adapted for a camera having a threaded hole and for a strap with two opposite ends fixed to the camera is provided. The fixing device includes a main body and a threaded post connected to the main body. The main body is configured to be removably disposed on the strap, and the threaded post is configured to be screwed into the threaded hole of the camera. When the main body is disposed on the strap and the threaded post is screwed into the threaded hole, the fixing device divides the strap into a first section and a second section that respectively form a first area and a second area with the camera.

10 Claims, 8 Drawing Sheets

FIXING DEVICE AND STRAP ASSEMBLY

TECHNICAL FIELD

The disclosure relates to a fixing device for camera strap and a strap assembly for camera.

BACKGROUND

Neck strap allows a camera to hang conveniently right in front of user's chest without holding it by hand, but the neck strap puts the weight of the camera on the neck and therefore can cause pain in the neck and back after a long day of shooting. Thus, in some cases, users would change the neck strap with a hand strap, the hand strap can hold the camera tight to one hand so as to keep the camera ready for shooting, but the downside of the hand strap is that the user only has one hand to handle other tasks.

Considering the neck and hand strap both have their advantages, thus some users are still willing to buy both, but changing strap involves quite cumbersome and time-consuming detaching and attaching work.

SUMMARY

One embodiment of the disclosure provides a fixing device adapted for a camera having a threaded hole and for a strap with two opposite ends fixed to the camera. The fixing device includes a main body and a threaded post connected to the main body. The main body is configured to be removably disposed on the strap, and the threaded post is configured to be screwed into the threaded hole of the camera. When the main body is disposed on the strap and the threaded post is screwed into the threaded hole, the fixing device divides the strap into a first section and a second section that respectively form a first area and a second area with the camera.

Another embodiment of the disclosure provides a strap assembly adapted for a camera having a threaded hole. The strap assembly includes a strap with two opposite ends configured to be fixed to the camera and a fixing device including a main body and a threaded post connected to the main body. A part of the strap is removably held by the main body, and the threaded post is removably screwed into the threaded hole of the camera. When the main body is disposed on the strap and the threaded post is screwed into the threaded hole, the fixing device divides the strap into a first section and a second section that respectively form a first area and a second area with the camera.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details.

Figure 1A:
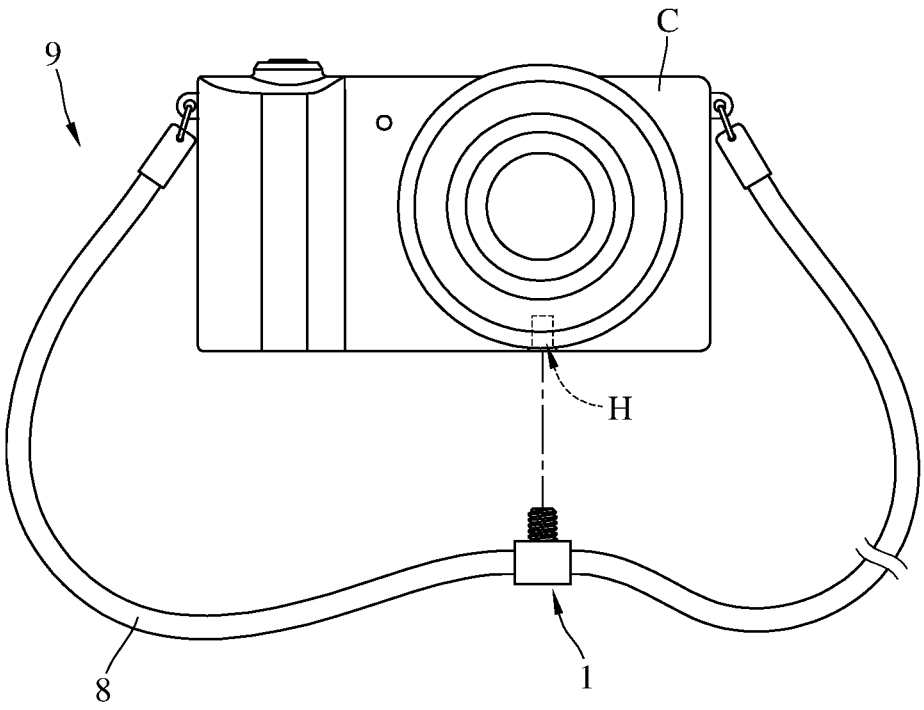
FIG. 1A-1B are simple illustrations showing the strap assembly of the disclosure being used on a camera.
Figure 1B:
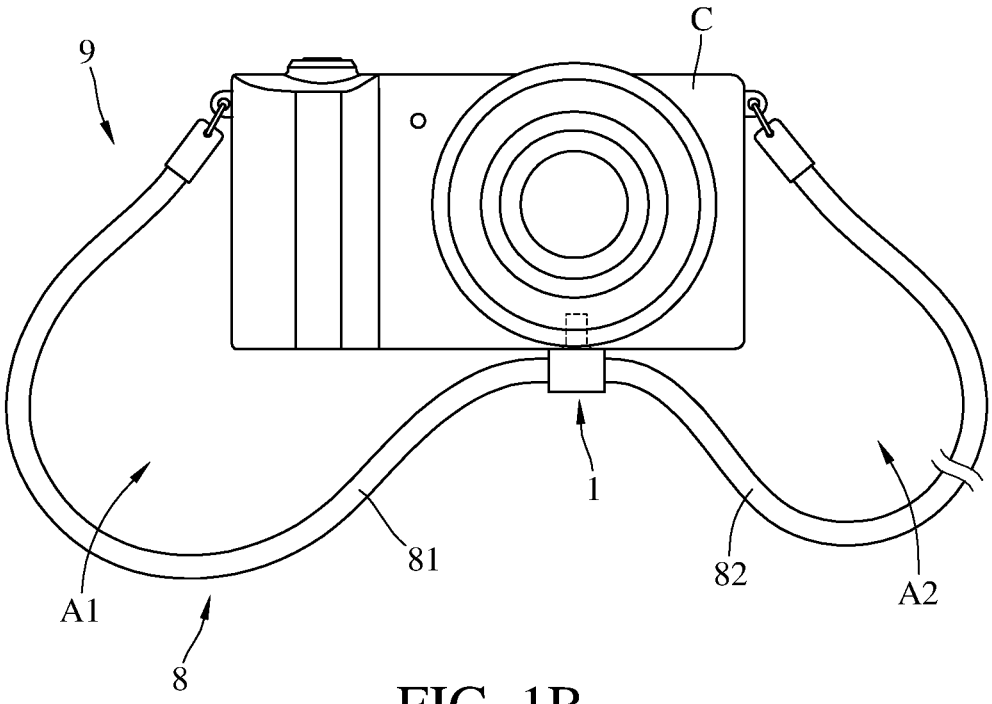
Figure 2:
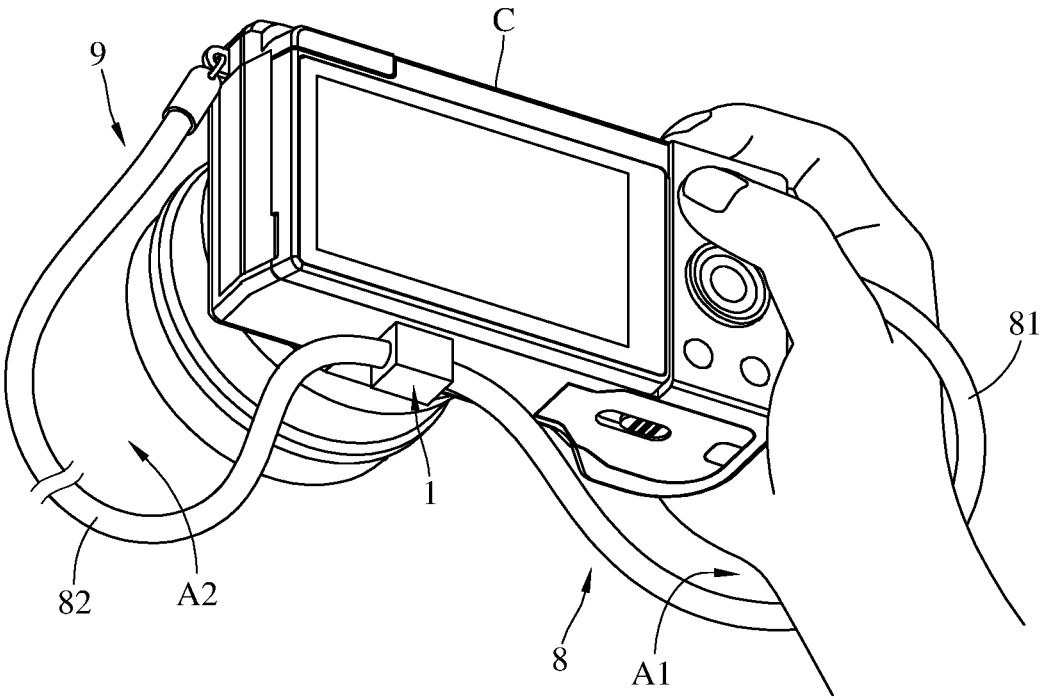
FIG. 2 depicts one of the modes of the strap assembly.

Referring to FIGS. 1A-2, a strap assembly 9 suitable for a camera C is provided. The camera C may be any typical camera with a threaded hole (also known as "tripod mount hole") H at its bottom. The strap assembly 9 includes a strap 8 and a fixing device 1. The strap 8 may be any typical neck camera strap having opposite ends that can be fixed to the camera C. The strap 8 may be a rope-shaped or flat-shaped camera strap. The fixing device 1 is configured to be removably disposed on any part of the strap 8 and is also configured to be removably fixed to the threaded hole H.

When a selected part of the strap 8 is fixed to the bottom of the camera C by the fixing device 1, the fixing device 1 divides the strap 8 into a first section 81 and a second section 82 that respectively form a first area A1 and a second area A2 with the camera C. The lengths of the first section 81 and the second section 82 (i.e., the sizes of the first area A1 and the second area A2) are adjustable depending on where the fixing device 1 is installed on the strap 8. As shown, the first section 81 may have a suitable length for it to be served as a hand or wrist camera strap. Accordingly, the fixing device 1 is able to turn part of a typical neck camera strap into a hand or wrist camera strap; that is, the strap assembly 9 is switchable to a neck strap mode (e.g., FIG. 1A) and a hand or wrist strap mode (e.g., FIGS. 1B-2).

Note that FIGS. 1A-2 are merely for explaining the basic concept of the disclosure and thus the fixing device 1 is depicted in simple line drawings. The exemplary embodiments of the strap assembly with reference to detailed illustration drawings are provided below.

Figure 3:
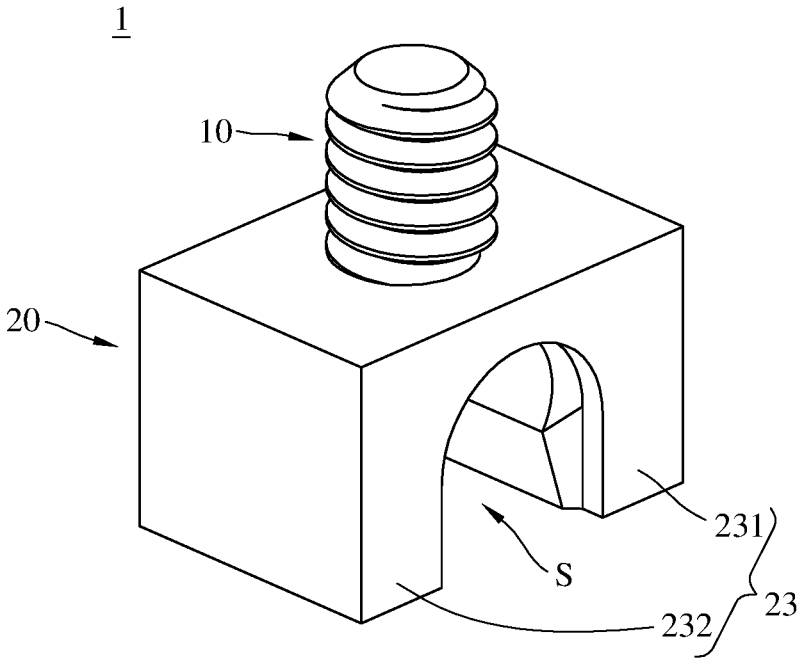
FIG. 3 depicts a fixing device according to one embodiment of the disclosure.

Referring to FIG. 3, the fixing device 1 may be an integrally formed piece including a threaded post 10 and a main body 20. The threaded post 10 protrudes outwards from the main body 20 and is configured to be screwed into the threaded hole H (shown in FIG. 1A). The main body 20 includes a holder 23 which includes a first holding part 231 and a second holding part 232, the first holding part 231 and the second holding part 232 define a holding space S therebetween with an opening at one end for receiving the strap 8, when a part of the strap 8 is in the holding space S, the part of the strap 8 is immovably clamped by and sandwiched between the first holding part 231 and the second holding part 232, thus the main body 20 can be engaged on any selected part of the strap 8. The holding space S may have a round shape fitting a rope-shaped camera strap. When a selected part of a camera strap is directly put into the holding space S of the main body 20 while the threaded post 10 is screwed into the threaded hole of the camera, that part is firmly attached to the camera.

Figure 4:
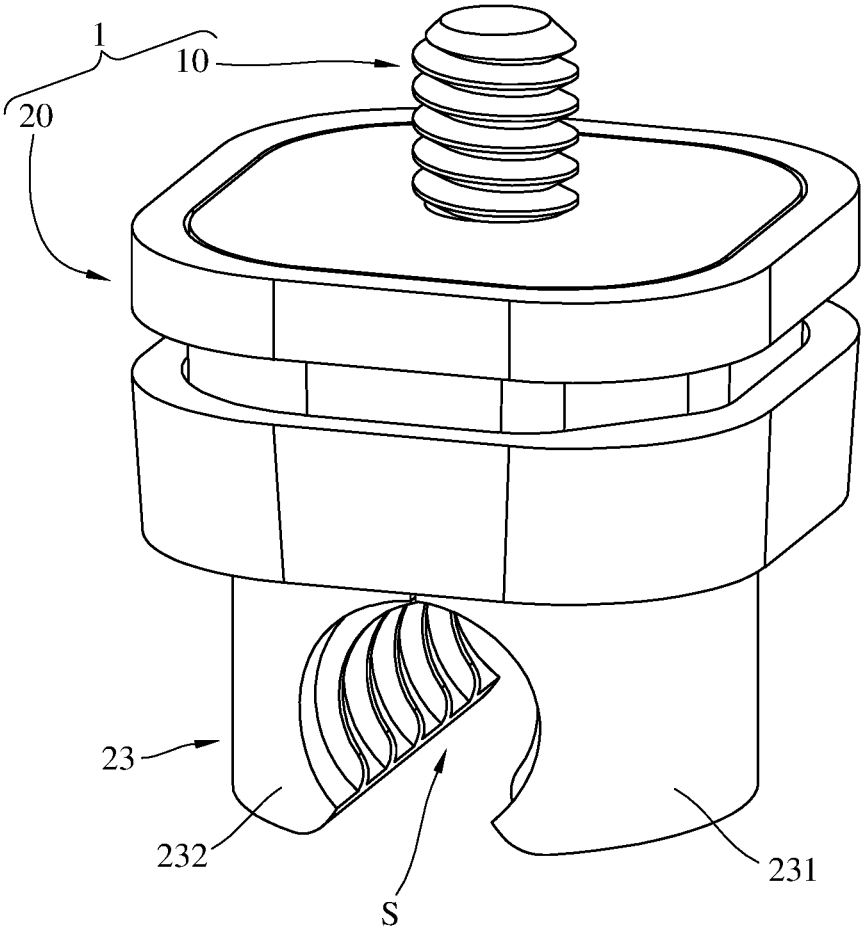
FIG. 4 depicts a fixing device according to one embodiment of the disclosure.
Figure 5:
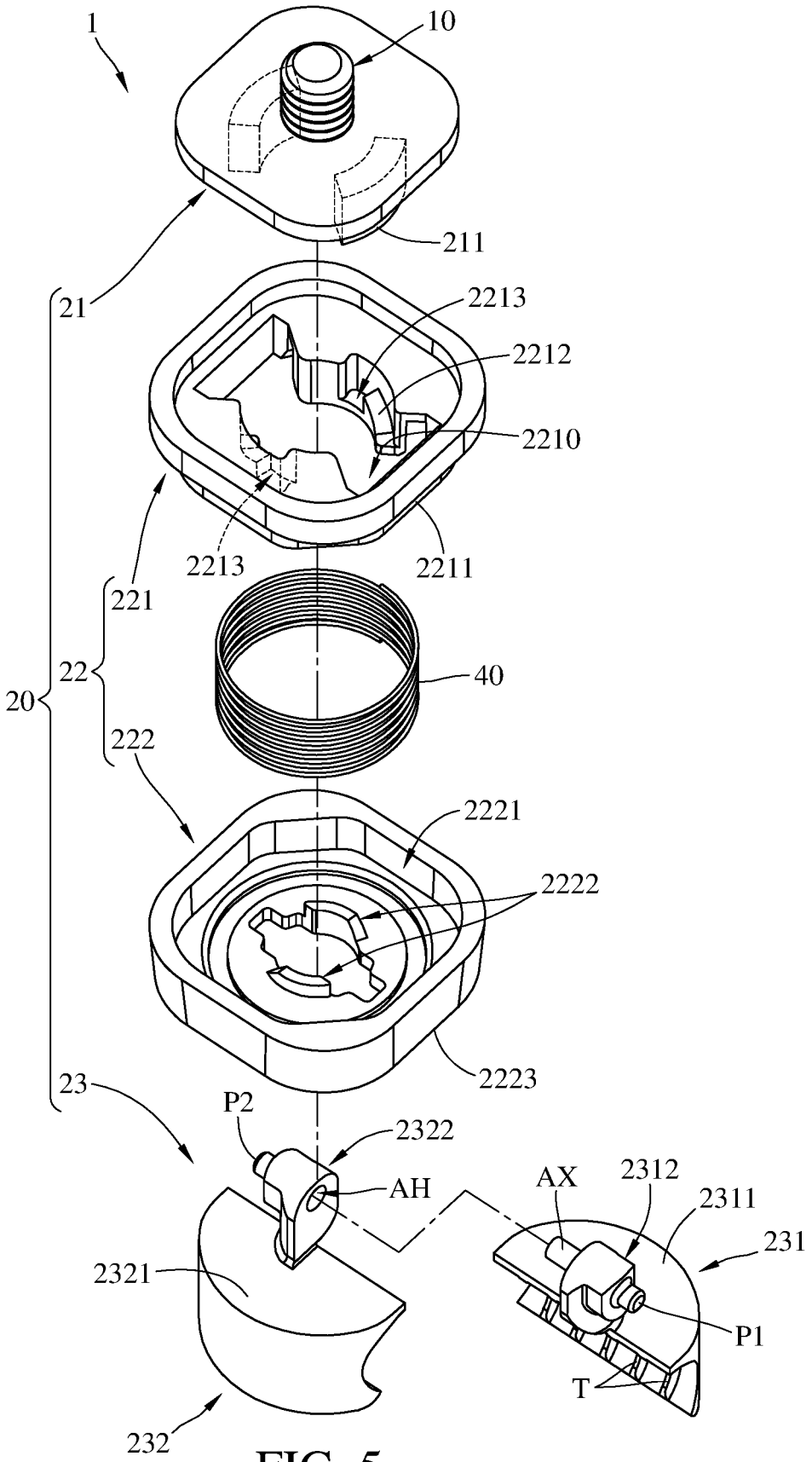
FIG. 5 is an exploded view of the fixing device.

Referring to FIGS. 4-5, the fixing device 1 may include an operable mechanism, the main body 20 may include a cover 21, an operating part 22, and a holder 23. The cover 21 is disposed on the operating part 22. The threaded post 10 may be integrally formed with the cover 21. The holder 23 is movably disposed on the operating part 22 and configured to hold or engage with the strap 8 (shown in FIG. 1A).

The operating part 22 may include a first movable component 221 and a second movable component 222 that both have a through hole at their center and connected to each other. The cover 21 covers the through holes and may be firmly fixed to the first movable component 221 via any suitable manner. Optionally, the cover 21 may have at least two insertion posts 211 configured to be inserted into insertion holes 2210 formed at two opposite sides of the through hole of the first movable component 221.

The first movable component 221 has an insertion portion 2211 configured to be inserted into an accommodation recess 2221 of the second movable component 222, the insertion portion 2211 has a contour mating the accommodation recess 2221, allowing the first movable component 221 to be stacked on the second movable component 222 and to be movable toward or away from the second movable component 222. There is a spring 40 disposed between and clamped by the first movable component 221 and the second movable component 222. The spring 40 may be a compression spring and is to force the first movable component 221 and the second movable component 222 to move away from each other.

The holder 23 includes a first holding part 231 and a second holding part 232 pivotably connected to each other and forming a holding space S in round shape therebetween for holding a rope-shaped strap. The first holding part 231 and the second holding part 232 may have one or more teeth T thereon and located in the holding space S in order to increase the friction with the strap.

The first holding part 231 and the second holding part 232 are movably disposed through the second movable component 222 and movably connected to the first movable component 221. The first holding part 231 and the second holding part 232 can separately pivot about their coaxial shaft, and also can together rotate about a direction perpendicular to the coaxial shaft so as to switch between an immovable status and a movable status. The first movable component 221 has two ramps 2212 and two retaining recesses 2213 at two opposite sides of the through hole thereof. The ramp 2212 faces away from the holder 23, and the retaining recess 2213 is formed at the part of the ramp 2212 located furthest away from the holder 23 and is recessed towards the holder 23. The second movable component 222 may have a contact surface 2223 facing the holder 23 and used to contact the first holding part 231 and the second holding part 232. The second movable component 222 may have two protruding blocks 2222 protruding in a direction away from the holder 23. The second movable component 222 are located in the through hole of the first movable component 221 and respectively adjacent to the retaining recesses 2213. The first holding part 231 may have a contact surface 2311, a connecting portion 2312, and a shaft P1. The contact surface 2311 contacts the contact surface 2223. The connecting portion 2312 is located above the contact surface 2311 and disposed through the through holes of the second movable component 222 and the first movable component 221. The shaft P1 protrudes from the connecting portion 2312 and slidably disposed on one of the ramps 2212. The second holding part 232 may have a contact surface 2321, a connecting portion 2322, and a shaft P2. The contact surface 2321 contacts the contact surface 2223. The connecting portion 2322 is located above the contact surface 2321 and disposed through the through holes of the second movable component 222 and the first movable component 221. The connecting portion 2312 is pivotably connected to the connecting portion 2322 via a pivot AX and a mating pivot hole AH thereon. The shaft P2 protrudes from the connecting portion 2322 and slidably disposed on the other ramps 2212. The shaft P1, the shaft P2, the pivot AX, and the pivot hole AH are coaxial, thus, the first holding part 231 and the second holding part 232 are pivotable about the same axis.

In FIGS. 6A-6D, when the shaft P1 and the shaft P2 are located at the lowest portion of the ramp 2212, the insertion posts 211 of the cover 21 keep them stay on the ramp 2212. At this moment, the spring 40 forces the second movable component 222 to be relatively away from the first movable component 221 so as to force the contact surface 2223 to contact the contact surface 2311 and the contact surface 2321, but the holder 23 is in the movable status and the second movable component 222 is also movable, thus, it is allowed to open the first holding part 231 and the second holding part 232 to put any selected part of the strap 8 into the holding space S. While the holder 23 is being opened, the motion of the holder 23 forces the shaft P1 and the shaft P2 to pull the first movable component 221 towards the second movable component 222. When the selected part of the strap 8 is in the holding space S, the holder 23 can be released, and then the spring 40 will restore the holder 23, the first movable component 221, and the second movable component 222 to their original positions.

Figure 6A:
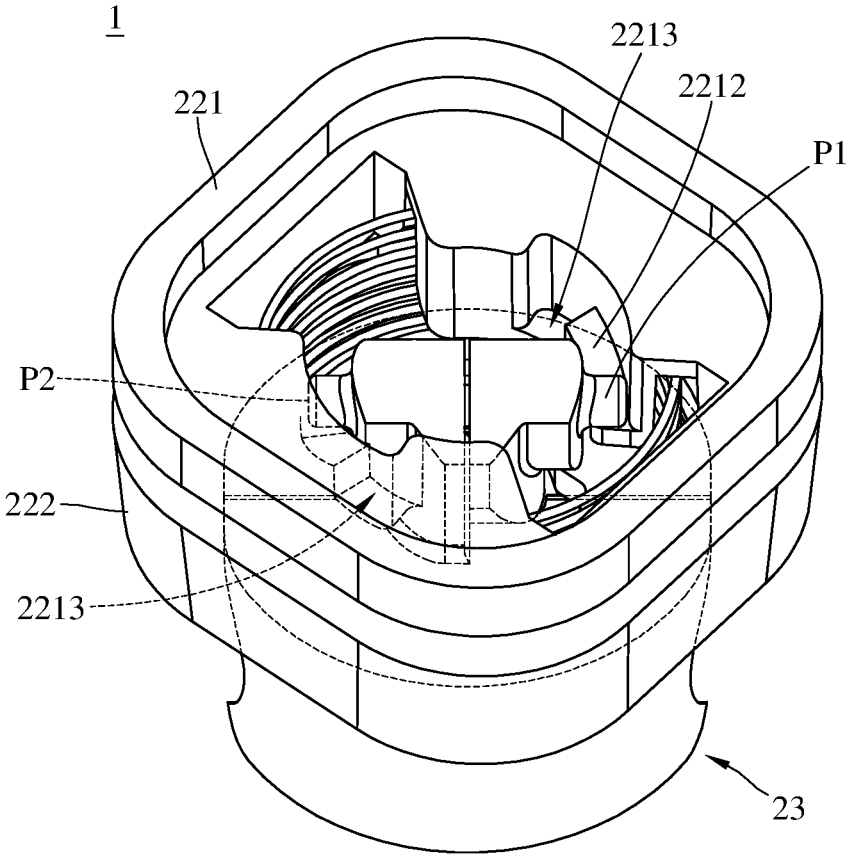
FIG. 6A is a perspective view of the fixing device when the cover is removed.
Figure 6B:
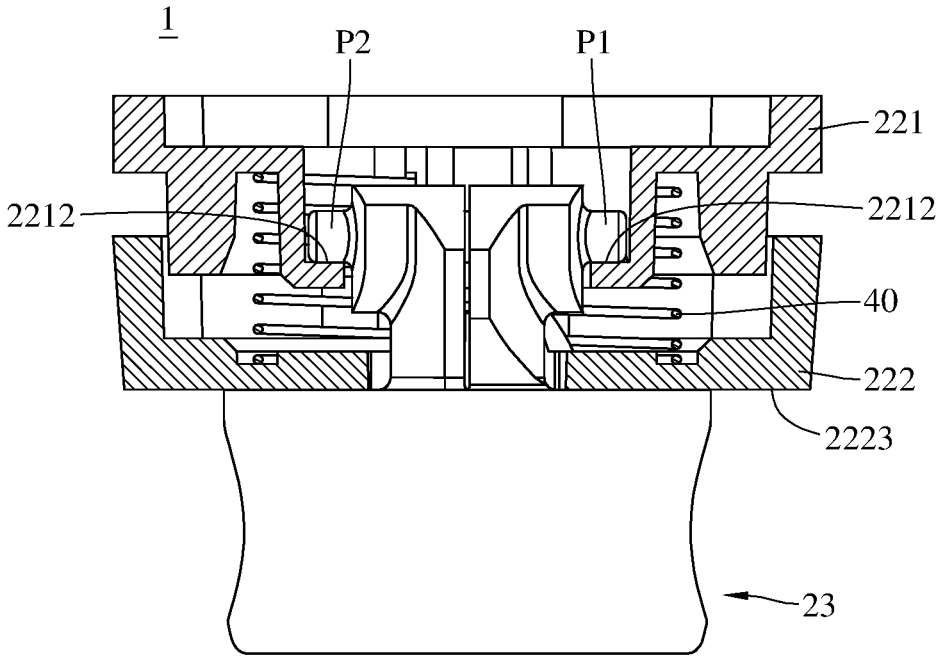
FIG. 6B is a cross-sectional side view of the fixing device in FIG. 6A.
Figure 6C:
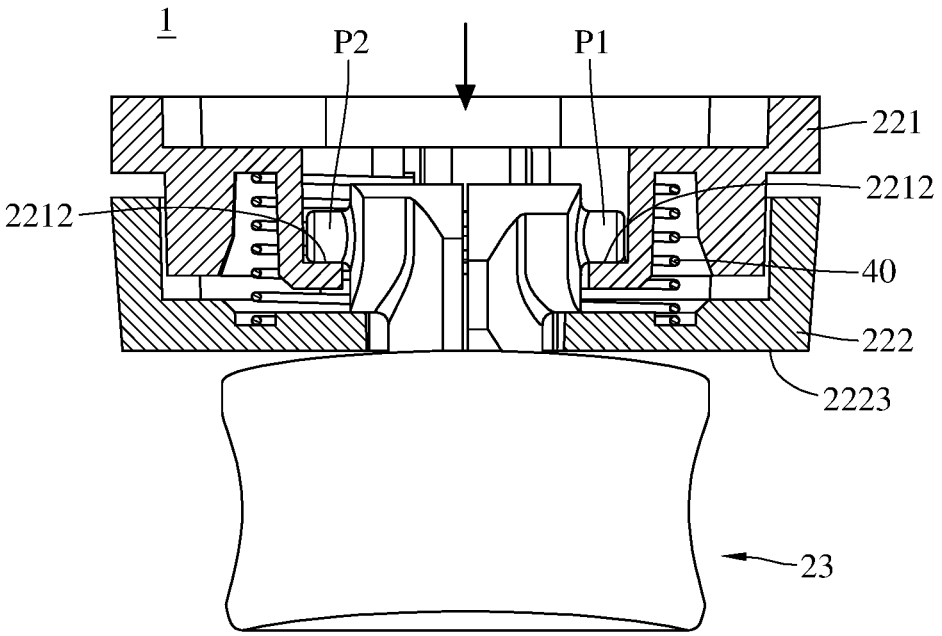
FIGS. 6C-6G illustrate the operation of the fixing device.
Figure 6D:
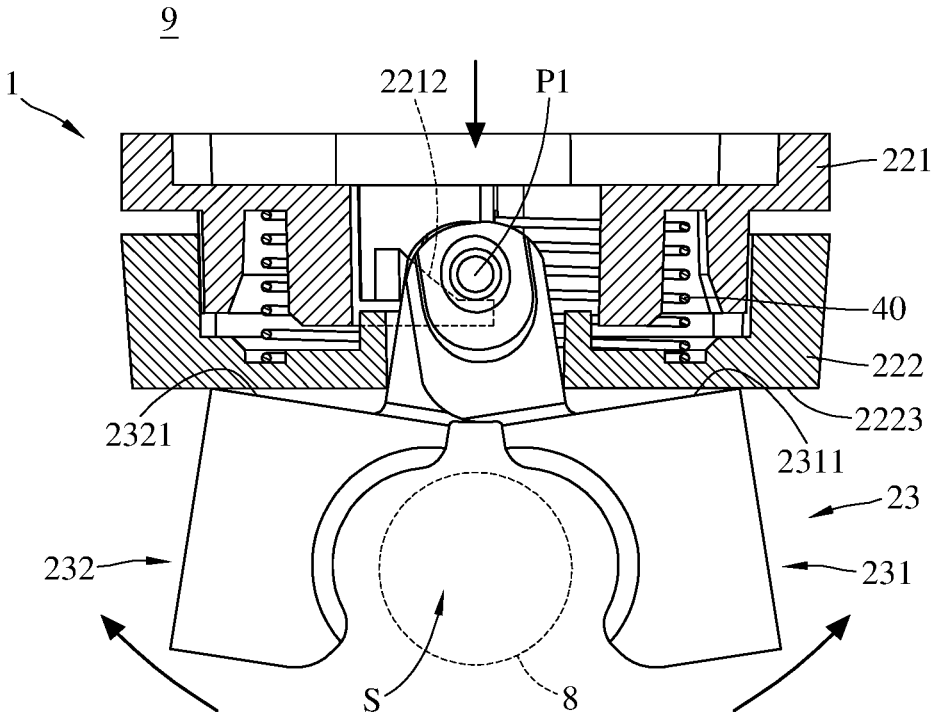
Figure 6E:
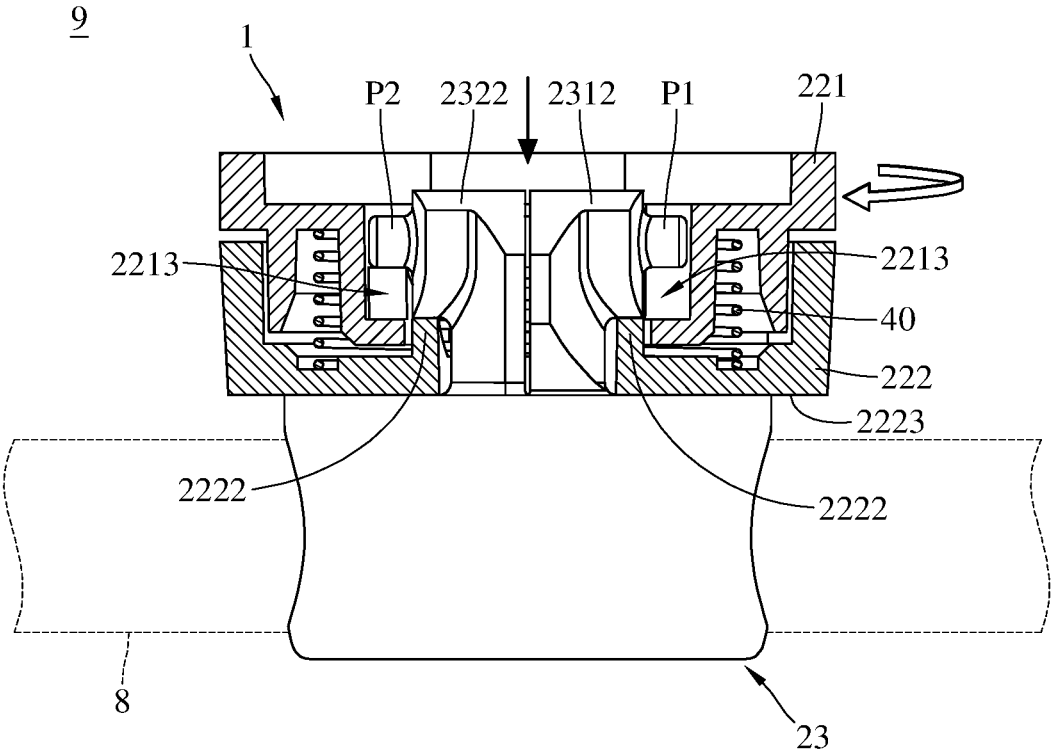
Figure 6F:
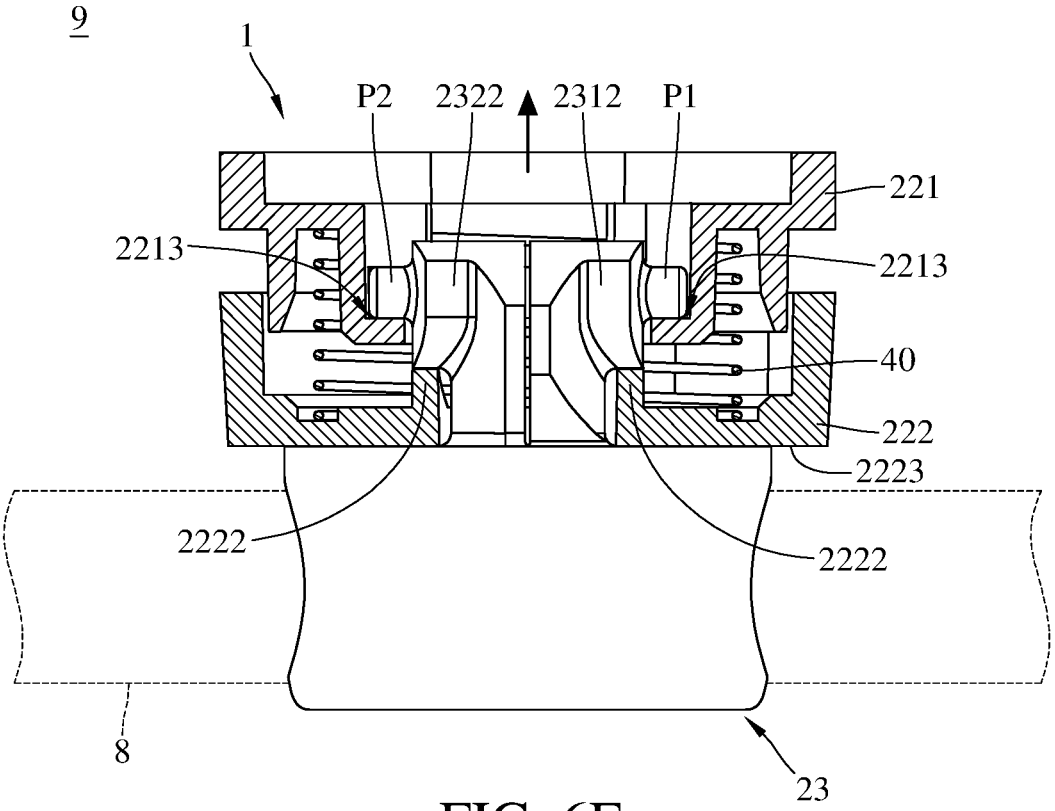

Then, referring to FIGS. 6E-6F, the operating part 22 and the holder 23 are rotated with respect to each other, by doing so, the first holding part 231 and the second holding part 232 are rotated with respect to the operating part 22 about a direction perpendicular to their axis, and the shaft P1 and the shaft P2 are moved toward the retaining recesses 2213 along the ramps 2212. During this step, the first holding part 231 and the second holding part 232 force the first movable component 221 to move closer to the second movable component 222 and to further deform the spring 40. When the shaft P1 and the shaft P2 reach the retaining recesses 2213, the first movable component 221 will be released from the shaft P1 and the shaft P2, such that the spring 40 is released to force the first movable component 221 and the second movable component 222 to move away from each other, causing the shaft P1 and the shaft P2 to enter into the retaining recesses 2213.

Figure 6G:
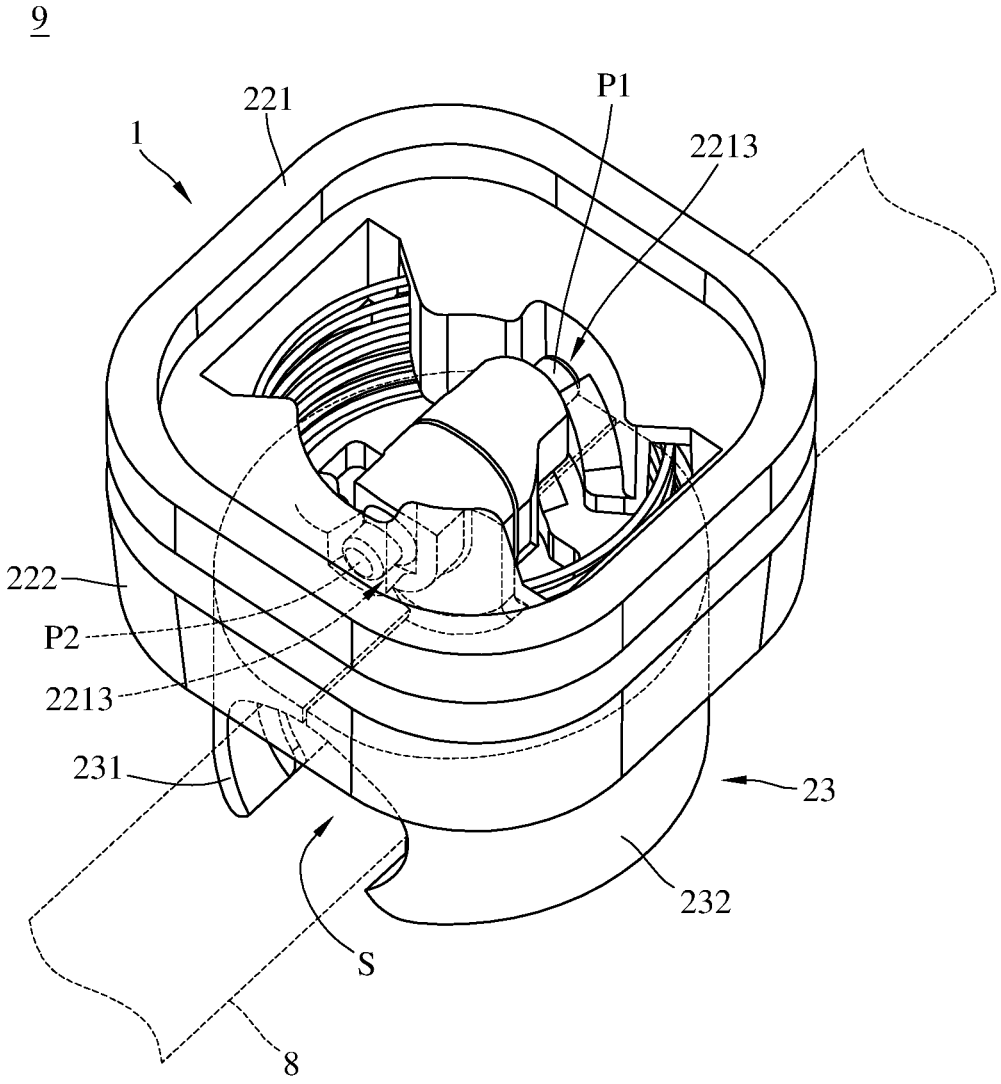

As a result, in FIG. 6F-6G, the shaft P1 and the shaft P2 are retained in the retaining recesses 2213, thus the first holding part 231 and the second holding part 232 are not allowed to rotate about the direction perpendicular to their axis, meanwhile, the connecting portion 2312 and the connecting portion 2322 are supported by the protruding blocks 2222 while the top surfaces of the holder 23 (i.e., the contact surface 2311 and the contact surface 2321) are in tight contact with the contact surface 2223 of the operating part 22, thus, the first holding part 231 and the second holding part 232 are not allowed to pivot about their shaft (i.e., the holder 23 is held in an immovable status by the operating part 22 and therefore is not allowed to be opened). As such, the holder 23 is currently prevented from being opened or rotated, thereby securing the holding of the strap 8. Then, the threaded post 10 can be screwed into the threaded hole at the bottom of a camera so as to quickly attach the selected part of a neck strap to the camera and to turn part of the neck strap into a hand or wrist strap (e.g., shown in FIGS. 1B and 2).

On the other hand, by moving the holder 23 and the first movable component 221 toward each other and then rotating one of them to remove the shaft P1 and the shaft P2 out of the retaining recesses 2213, the spring 40 can automatically turn the operating part 22 and the holder 23 back to the status shown in FIG. 6B.

Note that the fixing device of the disclosure is not limited to be used with rope-shaped camera strap. In other embodiments, the fixing device may have a main body having a holding space of slot shape that mates the cross-section of any typical flat-shaped camera strap; in another embodiment, the fixing device may have an L-shaped main body can be inserted into a punch hole of a strap; in yet another embodiment, the fixing device may have a threaded post having a threaded hole and a main body in a form of a bolt that can be disposed through the punch hole of a strap and screwed into the threaded hole of the threaded post.

As discussed above, the fixing device can be quickly installed on any selected part of any camera neck strap, enabling an easy and convenient attaching and detaching of the strap to the camera. Thus, the fixing device is able to quickly turn a neck strap into a wrist or hand strap. When the fixing device is installed on a camera strap, they can together become a strap assembly that is switchable to a neck strap mode and a hand or wrist strap mode.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A fixing device, adapted for a camera having a threaded hole and for a strap with two opposite ends fixed to the camera, the fixing device comprising:

a main body and a threaded post connected to the main body, wherein the main body comprises a holder having a first holding part and a second holding part which are configured for clamping the strap, the first holding part and the second holding part define a holding space therebetween with an opening for receiving the strap, and the threaded post is configured to be screwed into the threaded hole of the camera;

wherein, when a part of the strap is in the holding space and the threaded post is screwed into the threaded hole, the part of the strap is immovably clamped by and sandwiched between the first holding part and the second holding part so as to be firmly attached to the camera so that the fixing device divides the strap into a first section and a second section that respectively form a first area and a second area with the camera.

2. The fixing device according to claim 1, wherein the main body includes an operating part, the threaded post protrudes outwards from the operating part, the first holding part and the second holding part are pivotably connected to each other and movably disposed on the operating part, the holding space is in round shape therebetween for holding the strap.

3. The fixing device according to claim 2, wherein the first holding part and the second holding part each are pivotable with respect to the operating part about an axis and are rotatable with respect to the operating part about a direction perpendicular to the axis.

4. The fixing device according to claim 3, wherein the operating part comprises a first movable component, a second movable component stacked at one side of the first movable component, and a spring clamped between the first movable component and the second movable component, the first movable component has two ramps facing away from the holder and two retaining recesses respectively located at parts of the ramps located furthest away from the holder, the retaining recesses are recessed towards the holder, the second movable component has a contact surface facing the holder and two protruding blocks protruding away from the holder, the first holding part and the second holding part each have a shaft, the first holding part and the second holding part are disposed through the second movable component, the shafts are respectively slidably located on the ramps;

when the shafts are located on the ramps, the spring forces the contact surface of the second movable component to contact the holder;

when the holder is rotated with respect to the operating part to move the shafts along the ramps and to reach the retaining recesses, the spring moves the first movable component and the second movable component away from each other so that the shafts enter and are retained by the retaining recesses, and the first holding part and the second holding part are in contact with the protruding blocks and the contact surface of the second movable component so as to be held in an immovable status.

5. A strap assembly, adapted for a camera having a threaded hole, comprising:

a strap, with two opposite ends configured to be fixed to the camera; and a fixing device, comprising a main body and a threaded post connected to the main body, wherein the main body comprises a holder having a first holding part and a second holding part which are configured for clamping the strap, the first holding part and the second holding part define a holding space therebetween with an opening for receiving the strap, and the threaded post is configured to be removably screwed into the threaded hole of the camera;

when a part of the strap is in the holding space and the threaded post is screwed into the threaded hole, the part of the strap is immovably clamped by and sandwiched between the first holding part and the second holding part so as to be firmly attached to the camera so that the fixing device divides the strap into a first section and a second section that respectively form a first area and a second area with the camera.

6. The strap assembly according to claim 5, wherein the strap is a rope.

7. The strap assembly according to claim 5, wherein the strap is a neck camera strap, and at least one of the first section and the second section is configured to be a hand camera strap.

8. The strap assembly according to claim 5, wherein the main body includes an operating part, the threaded post protrudes outwards from the operating part, the first holding part and the second holding part are pivotably connected to each other and movably disposed on the operating part, the holding space is in round shape therebetween for holding the strap.

9. The strap assembly according to claim 8, wherein the first holding part and the second holding part each are pivotable with respect to the operating part about an axis and are rotatable with respect to the operating part about a direction perpendicular to the axis.

10. The strap assembly according to claim 9, wherein the operating part comprises a first movable component, a second movable component stacked at one side of the first movable component, and a spring clamped between the first movable component and the second movable component, the first movable component has two ramps facing away from the holder and two retaining recesses respectively located at parts of the ramps located furthest away from the holder, the retaining recesses are recessed towards the holder, the second movable component has a contact surface facing the holder and two protruding blocks protruding away from the holder, the first holding part and the second holding part each have a shaft, the first holding part and the second holding part are disposed through the second movable component, the shafts are respectively slidably located on the ramps, when the shafts are located on the ramps, the spring forces the contact surface of the second movable component to contact the holder, when the holder is rotated with respect to the operating part to move the shafts along the ramps and to reach the retaining recesses, the spring moves the first movable component and the second movable component away from each other so that the shafts enter and are retained by the retaining recesses, and the first holding part and the second holding part are in contact with the protruding blocks and the contact surface of the second movable component so as to be held in an immovable status.

* * * * *